US009048599B2

(12) United States Patent
Burris

(10) Patent No.: US 9,048,599 B2
(45) Date of Patent: Jun. 2, 2015

(54) COAXIAL CABLE CONNECTOR HAVING A GRIPPING MEMBER WITH A NOTCH AND DISPOSED INSIDE A SHELL

(71) Applicant: Corning Gilbert Inc., Glendale, AZ (US)

(72) Inventor: Donald Andrew Burris, Peoria, AZ (US)

(73) Assignee: Corning Gilbert Inc., Glendale, AZ (US)

( * ) Notice: Subject to any disclaimer, the term of this patent is extended or adjusted under 35 U.S.C. 154(b) by 0 days.

(21) Appl. No.: 14/086,595

(22) Filed: Nov. 21, 2013

(65) Prior Publication Data

US 2015/0118901 A1 Apr. 30, 2015

Related U.S. Application Data

(60) Provisional application No. 61/896,355, filed on Oct. 28, 2013.

(51) Int. Cl.

| | |
|---|---|
| ***H01R 9/05*** | (2006.01) |
| ***H01R 24/38*** | (2011.01) |
| ***H01R 13/59*** | (2006.01) |

(52) U.S. Cl.

CPC ..... *H01R 24/38* (2013.01); *H01R 13/59* (2013.01); *H01R 9/05* (2013.01)

(58) Field of Classification Search

USPC ..... 439/578–585

See application file for complete search history.

(56) References Cited

U.S. PATENT DOCUMENTS

| | | | |
|---|---|---|---|
| 331,169 | A | 11/1885 | Thomas |
| 346,958 | A | 8/1886 | Stone |
| 459,951 | A | 9/1891 | Warner |
| 589,216 | A | 8/1897 | McKee |
| 1,371,742 | A | 3/1921 | Dringman |
| 1,488,175 | A | 3/1924 | Strandell |
| 1,667,485 | A | 4/1928 | MacDonald |
| 1,766,869 | A | 6/1930 | Austin |
| 1,801,999 | A | 4/1931 | Bowman |
| 1,885,761 | A | 11/1932 | Peirce, Jr. |

(Continued)

FOREIGN PATENT DOCUMENTS

| | | |
|---|---|---|
| CA | 2096710 | 11/1994 |
| CN | 201149936 | 11/2008 |

(Continued)

OTHER PUBLICATIONS

Office Action dated Jun. 12, 2014 pertaining to U.S. Appl. No. 13/795,737.

(Continued)

*Primary Examiner* — Chandrika Prasad

(57) ABSTRACT

A gripping member for a coaxial cable connector is disclosed. The gripping member has a front end and a rear end opposite the front end, and an outer surface and an inner surface defining a longitudinal hole extending between the front end and the rear end. A first portion of the gripping member terminates at the front end. A second portion of the gripping member terminates at the rear end and includes at least one notch which extends from the inner surface of second portion to a certain depth from inner surface. The gripping member is configured to be forced under a body of a coaxial cable connector when driven axially forward by a shell of a coaxial cable connector to secure a coaxial cable to the connector.

14 Claims, 5 Drawing Sheets

(56) References Cited

U.S. PATENT DOCUMENTS 1,959,302 A 5/1934 Paige
2,013,526 A 9/1935 Schmitt
2,059,920 A 11/1936 Weatherhead, Jr. ..... 285/122
2,102,495 A 12/1937 England
2,258,528 A 10/1941 Wurzburger ..... 285/122
2,258,737 A 10/1941 Browne
2,325,549 A 7/1943 Ryzowitz
2,480,963 A 9/1949 Quinn
2,544,654 A 3/1951 Brown
2,549,647 A 4/1951 Turenne
2,694,187 A 11/1954 Nash
2,705,652 A 4/1955 Kaiser
2,754,487 A 7/1956 Carr et al.
2,755,331 A 7/1956 Melcher
2,757,351 A 7/1956 Klostermann
2,762,025 A 9/1956 Melcher
2,785,384 A 3/1957 Wickesser
2,805,399 A 9/1957 Leeper
2,816,949 A 12/1957 Curtiss
2,870,420 A 1/1959 Malek
2,878,039 A 3/1959 Hoegee et al.
2,881,406 A 4/1959 Arson ..... 339/59
2,963,536 A 12/1960 Kokalas ..... 174/77
3,001,169 A 9/1961 Blonder
3,015,794 A 1/1962 Kishbaugh
3,051,925 A 8/1962 Felts
3,091,748 A 5/1963 Takes et al.
3,094,364 A 6/1963 Lingg
3,103,548 A 9/1963 Concelman
3,140,106 A 7/1964 Thomas et al.
3,184,706 A 5/1965 Atkins
3,194,292 A 7/1965 Borowsky
3,196,382 A 7/1965 Morello, Jr.
3,206,540 A 9/1965 Cohen
3,245,027 A 4/1966 Ziegler, Jr.
3,275,913 A 9/1966 Blanchard et al.
3,278,890 A 10/1966 Cooney
3,281,756 A 10/1966 O'Keefe et al.
3,281,757 A 10/1966 Bonhomme
3,290,069 A 12/1966 Davis ..... 285/341
3,292,136 A 12/1966 Somerset
3,320,575 A 5/1967 Brown et al.
3,321,732 A 5/1967 Forney, Jr.
3,336,563 A 8/1967 Hyslop
3,348,186 A 10/1967 Rosen
3,350,667 A 10/1967 Shreve
3,350,677 A 10/1967 Daum
3,355,698 A 11/1967 Keller
3,372,364 A 3/1968 O'Keefe et al.
3,373,243 A 3/1968 Janowiak et al.
3,390,374 A 6/1968 Forney, Jr.
3,406,373 A 10/1968 Forney, Jr.
3,430,184 A 2/1969 Acord
3,448,430 A 6/1969 Kelly
3,453,376 A 7/1969 Ziegler, Jr. et al.
3,465,281 A 9/1969 Florer
3,475,545 A 10/1969 Stark et al.
3,494,400 A 2/1970 McCoy et al.
3,498,647 A 3/1970 Schroder
3,499,671 A 3/1970 Osborne ..... 285/341
3,501,737 A 3/1970 Harris et al.
3,517,373 A 6/1970 Jamon
3,526,871 A 9/1970 Hobart
3,533,051 A 10/1970 Ziegler, Jr.
3,537,065 A 10/1970 Winston
3,544,705 A 12/1970 Winston
3,551,882 A 12/1970 O'Keefe
3,564,487 A 2/1971 Upstone et al.
3,587,033 A 6/1971 Brorein et al.
3,596,933 A 8/1971 Luckenbill
3,601,776 A 8/1971 Curl
3,603,912 A 9/1971 Kelly ..... 339/89 C
3,614,711 A 10/1971 Anderson et al.
3,622,952 A 11/1971 Hilbert ..... 339/177 R
3,629,792 A 12/1971 Dorrell
3,633,150 A 1/1972 Schwartz
3,646,502 A 2/1972 Hutter et al.
3,663,926 A 5/1972 Brandt
3,665,371 A 5/1972 Cripps
3,668,612 A 6/1972 Nepovim
3,669,472 A 6/1972 Nadsady
3,671,922 A 6/1972 Zerlin et al.
3,671,926 A 6/1972 Nepovim
3,678,444 A 7/1972 Stevens et al.
3,678,445 A 7/1972 Brancaleone
3,680,034 A 7/1972 Chow et al.
3,681,739 A 8/1972 Kornick
3,683,320 A 8/1972 Woods et al.
3,686,623 A 8/1972 Nijman
3,694,792 A 9/1972 Wallo
3,694,793 A 9/1972 Concelman
3,697,930 A 10/1972 Shirey
3,706,958 A 12/1972 Blanchenot
3,708,186 A 1/1973 Takagi et al. ..... 285/341
3,710,005 A 1/1973 French
3,739,076 A 6/1973 Schwartz
3,744,007 A 7/1973 Horak
3,744,011 A 7/1973 Blanchenot
3,761,870 A 9/1973 Drezin et al.
3,778,535 A 12/1973 Forney, Jr.
3,781,762 A 12/1973 Quackenbush
3,781,898 A 12/1973 Holloway
3,783,178 A 1/1974 Philibert et al.
3,787,796 A 1/1974 Barr ..... 339/60 R
3,793,610 A 2/1974 Brishka
3,798,589 A 3/1974 Deardurff
3,808,580 A 4/1974 Johnson
3,810,076 A 5/1974 Hutter
3,835,443 A 9/1974 Arnold et al.
3,836,700 A 9/1974 Niemeyer
3,845,453 A 10/1974 Hemmer
3,846,738 A 11/1974 Nepovim
3,854,003 A 12/1974 Duret
3,854,789 A 12/1974 Kaplan
3,858,156 A 12/1974 Zarro
3,879,102 A 4/1975 Horak
3,886,301 A 5/1975 Cronin et al.
3,907,335 A 9/1975 Burge et al. ..... 285/23
3,907,399 A 9/1975 Spinner
3,910,673 A 10/1975 Stokes
3,915,539 A 10/1975 Collins
3,936,132 A 2/1976 Hutter
3,937,547 A 2/1976 Lee-Kemp
3,953,097 A 4/1976 Graham
3,960,428 A 6/1976 Naus et al.
3,963,320 A 6/1976 Spinner
3,963,321 A 6/1976 Burger et al.
3,970,355 A 7/1976 Pitschi
3,972,013 A 7/1976 Shapiro
3,976,352 A 8/1976 Spinner
3,980,805 A 9/1976 Lipari
3,985,418 A 10/1976 Spinner
3,986,736 A 10/1976 Takagi et al. ..... 285/341
4,017,139 A 4/1977 Nelson
4,022,966 A 5/1977 Gajajiva ..... 174/65 SS
4,030,742 A 6/1977 Eidelberg et al.
4,030,798 A 6/1977 Paoli
4,032,177 A 6/1977 Anderson ..... 285/24
4,045,706 A 8/1977 Daffner et al.
4,046,451 A 9/1977 Juds et al.
4,053,200 A 10/1977 Pugner
4,056,043 A 11/1977 Sriramamurty et al.
4,059,330 A 11/1977 Shirey
4,079,343 A 3/1978 Nijman
4,082,404 A 4/1978 Flatt
4,090,028 A 5/1978 Vontobel
4,093,335 A 6/1978 Schwartz et al.
4,100,943 A 7/1978 Terada et al. ..... 139/201
4,106,839 A 8/1978 Cooper
4,109,126 A 8/1978 Halbeck
4,125,308 A 11/1978 Schilling
4,126,372 A 11/1978 Hashimoto et al.
4,131,332 A 12/1978 Hogendobler et al.
4,136,897 A 1/1979 Haluch ..... 285/342

(56) References Cited

U.S. PATENT DOCUMENTS 4,150,250 A 4/1979 Lundeberg
4,153,320 A 5/1979 Townshend
4,156,554 A 5/1979 Aujla ..... 339/177 R
4,165,911 A 8/1979 Laudig
4,168,921 A 9/1979 Blanchard
4,173,385 A 11/1979 Fenn et al.
4,174,875 A 11/1979 Wilson et al.
4,187,481 A 2/1980 Bourtos
4,193,655 A 3/1980 Herrmann, Jr.
4,194,338 A 3/1980 Trafton
4,206,963 A 6/1980 English et al.
4,212,487 A 7/1980 Jones et al.
4,225,162 A 9/1980 Dola
4,227,765 A 10/1980 Neumann et al.
4,229,714 A 10/1980 Yu
4,250,348 A 2/1981 Kitagawa
4,273,405 A 6/1981 Law
4,280,749 A 7/1981 Hemmer
4,285,564 A 8/1981 Spinner
4,290,663 A 9/1981 Fowler et al.
4,296,986 A 10/1981 Herrmann, Jr.
4,307,926 A 12/1981 Smith
4,309,050 A 1/1982 Legris ..... 285/341
4,310,211 A 1/1982 Bunnell et al. ..... 339/91 R
4,322,121 A 3/1982 Riches et al.
4,326,769 A 4/1982 Dorsey et al.
4,334,730 A 6/1982 Colwell et al.
4,339,166 A 7/1982 Dayton
4,346,958 A 8/1982 Blanchard
4,354,721 A 10/1982 Luzzi
4,358,174 A 11/1982 Dreyer
4,373,767 A 2/1983 Cairns
4,389,081 A 6/1983 Gallusser et al.
4,400,050 A 8/1983 Hayward
4,407,529 A 10/1983 Holman
4,408,821 A 10/1983 Forney, Jr.
4,408,822 A 10/1983 Nikitas
4,412,717 A 11/1983 Monroe
4,421,377 A 12/1983 Spinner
4,426,127 A 1/1984 Kubota
4,444,453 A 4/1984 Kirby et al.
4,452,503 A 6/1984 Forney, Jr.
4,456,323 A 6/1984 Pitcher et al.
4,462,653 A 7/1984 Flederbach et al.
4,464,000 A 8/1984 Werth et al.
4,464,001 A 8/1984 Collins
4,469,386 A 9/1984 Ackerman
4,470,657 A 9/1984 Deacon
4,477,132 A 10/1984 Moser et al.
4,484,792 A 11/1984 Tengler et al.
4,484,796 A 11/1984 Sato et al.
4,490,576 A 12/1984 Bolante et al.
4,506,943 A 3/1985 Drogo
4,515,427 A 5/1985 Smit
4,525,017 A 6/1985 Schildkraut et al.
4,531,790 A 7/1985 Selvin
4,531,805 A 7/1985 Werth
4,533,191 A 8/1985 Blackwood
4,540,231 A 9/1985 Forney, Jr.
RE31,995 E 10/1985 Ball
4,545,633 A 10/1985 McGeary
4,545,637 A 10/1985 Bosshard et al.
4,575,274 A 3/1986 Hayward
4,580,862 A 4/1986 Johnson
4,580,865 A 4/1986 Fryberger
4,583,811 A 4/1986 McMills
4,585,289 A 4/1986 Bocher
4,588,246 A 5/1986 Schildkraut et al.
4,593,964 A 6/1986 Forney, Jr. et al.
4,596,434 A 6/1986 Saba et al.
4,596,435 A 6/1986 Bickford
4,597,621 A 7/1986 Burns
4,598,959 A 7/1986 Selvin
4,598,961 A 7/1986 Cohen
4,600,263 A 7/1986 DeChamp et al.
4,613,199 A 9/1986 McGeary
4,614,390 A 9/1986 Baker
4,616,900 A 10/1986 Cairns
4,632,487 A 12/1986 Wargula
4,634,213 A 1/1987 Larsson et al.
4,640,572 A 2/1987 Conlon
4,645,281 A 2/1987 Burger
4,647,135 A 3/1987 Reinhardt
4,650,228 A 3/1987 McMills et al.
4,655,159 A 4/1987 McMills
4,655,534 A 4/1987 Stursa
4,660,921 A 4/1987 Hauver
4,666,190 A 5/1987 Yamabe et al.
4,668,043 A 5/1987 Saba et al.
4,673,236 A 6/1987 Musolff et al.
4,674,818 A 6/1987 McMills et al.
4,676,577 A 6/1987 Szegda
4,682,832 A 7/1987 Punako et al.
4,684,201 A 8/1987 Hutter
4,688,876 A 8/1987 Morelli
4,688,878 A 8/1987 Cohen et al.
4,690,482 A 9/1987 Chamberland et al.
4,691,976 A 9/1987 Cowen
4,703,987 A 11/1987 Gallusser et al.
4,703,988 A 11/1987 Raux et al.
4,713,021 A 12/1987 Kobler ..... 439/272
4,717,355 A 1/1988 Mattis
4,720,155 A 1/1988 Schildkraut et al.
4,728,301 A 3/1988 Hemmer et al.
4,734,050 A 3/1988 Negre et al.
4,734,666 A 3/1988 Ohya et al.
4,737,123 A 4/1988 Paler et al.
4,738,009 A 4/1988 Down et al.
4,738,628 A 4/1988 Rees
4,739,126 A 4/1988 Gutter et al.
4,746,305 A 5/1988 Nomura
4,747,656 A 5/1988 Miyahara et al.
4,747,786 A 5/1988 Hayashi et al.
4,749,821 A 6/1988 Linton et al.
4,755,152 A 7/1988 Elliot et al.
4,757,297 A 7/1988 Frawley
4,759,729 A 7/1988 Kemppainen et al.
4,761,146 A 8/1988 Sohoel
4,772,222 A 9/1988 Laudig et al.
4,789,355 A 12/1988 Lee
4,789,759 A 12/1988 Jones
4,795,360 A 1/1989 Newman et al.
4,797,120 A 1/1989 Ulery
4,806,116 A 2/1989 Ackerman
4,807,891 A 2/1989 Neher
4,808,128 A 2/1989 Werth
4,810,017 A 3/1989 Knak et al.
4,813,886 A 3/1989 Roos et al.
4,820,185 A 4/1989 Moulin
4,834,675 A 5/1989 Samchisen
4,834,676 A 5/1989 Tackett
4,835,342 A 5/1989 Guginsky
4,836,580 A 6/1989 Farrell
4,836,801 A 6/1989 Ramirez
4,838,813 A 6/1989 Pauza et al.
4,846,731 A 7/1989 Alwine
4,854,893 A 8/1989 Morris
4,857,014 A 8/1989 Alf et al.
4,867,489 A 9/1989 Patel ..... 285/342
4,867,706 A 9/1989 Tang
4,869,679 A 9/1989 Szegda
4,874,331 A 10/1989 Iverson
4,881,912 A 11/1989 Thommen et al.
4,892,275 A 1/1990 Szegda
4,902,246 A 2/1990 Samchisen
4,906,207 A 3/1990 Banning et al.
4,915,651 A 4/1990 Bout
4,921,447 A 5/1990 Capp et al.
4,923,412 A 5/1990 Morris
4,925,403 A 5/1990 Zorzy
4,927,385 A 5/1990 Cheng
4,929,188 A 5/1990 Lionetto et al.
4,934,960 A 6/1990 Capp et al.
4,938,718 A 7/1990 Guendel

(56) References Cited

U.S. PATENT DOCUMENTS 4,941,846 A 7/1990 Guimond et al.
4,952,174 A 8/1990 Sucht et al.
4,957,456 A 9/1990 Olson et al.
4,973,265 A 11/1990 Heeren
4,979,911 A 12/1990 Spencer
4,990,104 A 2/1991 Schieferly
4,990,105 A 2/1991 Karlovich
4,990,106 A 2/1991 Szegda
4,992,061 A 2/1991 Brush, Jr. et al.
5,002,503 A 3/1991 Campbell et al.
5,007,861 A 4/1991 Stirling
5,011,422 A 4/1991 Yeh
5,011,432 A 4/1991 Sucht et al.
5,018,822 A 5/1991 Freismuth et al.
5,021,010 A 6/1991 Wright
5,024,606 A 6/1991 Ming-Hwa
5,030,126 A 7/1991 Hanlon
5,037,328 A 8/1991 Karlovich
5,046,964 A 9/1991 Welsh et al.
5,052,947 A 10/1991 Brodie et al.
5,055,060 A 10/1991 Down et al.
5,059,139 A 10/1991 Spinner
5,059,747 A 10/1991 Bawa et al.
5,062,804 A 11/1991 Jamet et al.
5,066,248 A 11/1991 Gaver, Jr. et al.
5,067,912 A 11/1991 Bickford et al.
5,073,129 A 12/1991 Szegda
5,080,600 A 1/1992 Baker et al.
5,083,943 A 1/1992 Tarrant
5,120,260 A 6/1992 Jackson
5,127,853 A 7/1992 McMills et al.
5,131,862 A 7/1992 Gershfeld
5,137,470 A 8/1992 Doles
5,137,471 A 8/1992 Verespej et al.
5,141,448 A 8/1992 Mattingly et al.
5,141,451 A 8/1992 Down
5,149,274 A 9/1992 Gallusser et al.
5,150,924 A 9/1992 Yokomatsu et al.
5,154,636 A 10/1992 Vaccaro et al.
5,161,993 A 11/1992 Leibfried, Jr.
5,166,477 A 11/1992 Perin, Jr. et al.
5,167,545 A 12/1992 O'Brien et al.
5,169,323 A 12/1992 Kawai et al.
5,181,161 A 1/1993 Hirose et al.
5,183,417 A 2/1993 Bools
5,186,501 A 2/1993 Mano
5,186,655 A 2/1993 Glenday et al.
5,195,905 A 3/1993 Pesci
5,195,906 A 3/1993 Szegda
5,205,547 A 4/1993 Mattingly
5,205,761 A 4/1993 Nilsson
5,207,602 A 5/1993 McMills et al.
5,215,477 A 6/1993 Weber et al.
5,217,391 A 6/1993 Fisher, Jr.
5,217,392 A 6/1993 Hosler, Sr.
5,217,393 A 6/1993 Del Negro et al.
5,221,216 A 6/1993 Gabany et al.
5,227,587 A 7/1993 Paterek
5,247,424 A 9/1993 Harris et al.
5,269,701 A 12/1993 Leibfried, Jr.
5,281,762 A 1/1994 Long et al.
5,283,853 A 2/1994 Szegda
5,284,449 A 2/1994 Vaccaro
5,294,864 A 3/1994 Do
5,295,864 A 3/1994 Birch et al.
5,316,348 A 5/1994 Franklin
5,316,494 A 5/1994 Flanagan et al.
5,318,459 A 6/1994 Sheilds
5,321,205 A 6/1994 Bawa et al.
5,334,032 A 8/1994 Myers et al.
5,334,051 A 8/1994 Devine et al.
5,338,225 A 8/1994 Jacobsen et al.
5,342,218 A 8/1994 McMills et al.
5,354,217 A 10/1994 Gabel et al.
5,362,250 A 11/1994 McMills et al.
5,362,251 A 11/1994 Bielak
5,366,260 A 11/1994 Wartluft
5,371,819 A 12/1994 Szegda
5,371,821 A 12/1994 Szegda
5,371,827 A 12/1994 Szegda
5,380,211 A 1/1995 Kawagauchi et al.
5,389,005 A 2/1995 Kodama
5,393,244 A 2/1995 Szegda
5,397,252 A 3/1995 Wang
5,413,504 A 5/1995 Kloecker et al.
5,431,583 A 7/1995 Szegda
5,435,745 A 7/1995 Booth
5,435,751 A 7/1995 Papenheim et al.
5,435,760 A 7/1995 Miklos
5,439,386 A 8/1995 Ellis et al.
5,444,810 A 8/1995 Szegda
5,455,548 A 10/1995 Grandchamp et al.
5,456,611 A 10/1995 Henry et al.
5,456,614 A 10/1995 Szegda
5,466,173 A 11/1995 Down
5,470,257 A 11/1995 Szegda
5,474,478 A 12/1995 Ballog
5,488,268 A 1/1996 Bauer et al.
5,490,033 A 2/1996 Cronin
5,490,801 A 2/1996 Fisher, Jr. et al.
5,494,454 A 2/1996 Johnsen
5,499,934 A 3/1996 Jacobsen et al.
5,501,616 A 3/1996 Holliday
5,516,303 A 5/1996 Yohn et al.
5,525,076 A 6/1996 Down
5,542,861 A 8/1996 Anhalt et al.
5,548,088 A 8/1996 Gray et al.
5,550,521 A 8/1996 Bernaud et al.
5,564,938 A 10/1996 Shenkal et al.
5,571,028 A 11/1996 Szegda
5,586,910 A 12/1996 Del Negro et al.
5,595,499 A 1/1997 Zander et al.
5,598,132 A 1/1997 Stabile
5,607,320 A 3/1997 Wright
5,607,325 A 3/1997 Toma
5,609,501 A 3/1997 McMills et al.
5,620,339 A 4/1997 Gray et al.
5,632,637 A 5/1997 Diener
5,632,651 A 5/1997 Szegda
5,644,104 A 7/1997 Porter et al.
5,649,723 A 7/1997 Larsson
5,651,698 A 7/1997 Locati et al.
5,651,699 A 7/1997 Holliday
5,653,605 A 8/1997 Woehl et al.
5,667,405 A 9/1997 Holliday
5,681,172 A 10/1997 Moldenhauer
5,683,263 A 11/1997 Hsu
5,702,263 A 12/1997 Baumann et al.
5,722,856 A 3/1998 Fuchs et al.
5,735,704 A 4/1998 Anthony
5,743,131 A 4/1998 Holliday et al.
5,746,617 A 5/1998 Porter, Jr. et al.
5,746,619 A 5/1998 Harting et al.
5,769,652 A 6/1998 Wider
5,774,344 A 6/1998 Casebolt
5,775,927 A 7/1998 Wider
5,788,289 A 8/1998 Cronley
5,791,698 A 8/1998 Wartluft et al.
5,797,633 A 8/1998 Katzer et al.
5,817,978 A 10/1998 Hermant et al.
5,863,220 A 1/1999 Holliday
5,877,452 A 3/1999 McConnell
5,879,191 A 3/1999 Burris
5,882,226 A 3/1999 Bell et al.
5,897,795 A 4/1999 Lu et al.
5,906,511 A 5/1999 Bozzer et al.
5,917,153 A 6/1999 Geroldinger ..... 174/88 C
5,921,793 A 7/1999 Phillips
5,938,465 A 8/1999 Fox, Sr.
5,944,548 A 8/1999 Saito
5,951,327 A 9/1999 Marik
5,954,708 A 9/1999 Lopez et al.
5,957,716 A 9/1999 Buckley et al.
5,967,852 A 10/1999 Follingstad et al.

(56) References Cited

U.S. PATENT DOCUMENTS 5,975,479 A 11/1999 Suter
5,975,591 A 11/1999 Guest
5,975,949 A 11/1999 Holliday et al.
5,975,951 A 11/1999 Burris et al.
5,977,841 A 11/1999 Lee et al.
5,997,350 A 12/1999 Burris et al.
6,010,349 A 1/2000 Porter, Jr.
6,019,635 A 2/2000 Nelson
6,022,237 A 2/2000 Esh
6,032,358 A 3/2000 Wild
6,036,540 A 3/2000 Beloritsky
6,042,422 A 3/2000 Youtsey
6,048,229 A 4/2000 Lazaro, Jr.
6,053,743 A 4/2000 Mitchell et al.
6,053,769 A 4/2000 Kubota et al.
6,053,777 A 4/2000 Boyle
6,062,607 A 5/2000 Bartholomew
6,080,015 A 6/2000 Andreescu
6,083,053 A 7/2000 Anderson, Jr. et al.
6,089,903 A 7/2000 Stafford Gray et al.
6,089,912 A 7/2000 Tallis et al.
6,089,913 A 7/2000 Holliday
6,093,043 A 7/2000 Gray et al.
6,095,828 A 8/2000 Burland
6,095,841 A 8/2000 Felps
6,123,550 A 9/2000 Burkert et al.
6,123,567 A 9/2000 McCarthy
6,132,234 A 10/2000 Waidner et al.
6,146,197 A 11/2000 Holliday et al.
6,152,752 A 11/2000 Fukuda
6,152,753 A 11/2000 Johnson et al.
6,153,830 A 11/2000 Montena
6,162,995 A 12/2000 Bachle et al.
6,164,977 A 12/2000 Lester
6,174,206 B1 1/2001 Yentile et al.
6,183,298 B1 2/2001 Henningsen
6,199,913 B1 3/2001 Wang
6,199,920 B1 3/2001 Neustadtl
6,210,216 B1 4/2001 Tso-Chin et al.
6,210,219 B1 4/2001 Zhu et al.
6,210,222 B1 4/2001 Langham et al.
6,217,383 B1 4/2001 Holland et al.
6,238,240 B1 5/2001 Yu
6,239,359 B1 5/2001 Lilienthal, II et al.
6,241,553 B1 6/2001 Hsia
6,250,974 B1 6/2001 Kerek
6,257,923 B1 7/2001 Stone et al.
6,261,126 B1 7/2001 Stirling
6,267,612 B1 7/2001 Arcykiewicz et al.
6,271,464 B1 8/2001 Cunningham
6,331,123 B1 12/2001 Rodrigues
6,332,815 B1 12/2001 Bruce
6,352,448 B1 3/2002 Holliday et al.
6,358,077 B1 3/2002 Young
6,361,348 B1 3/2002 Hall et al.
6,361,364 B1 3/2002 Holland et al.
6,375,509 B2 4/2002 Mountford
6,394,840 B1 5/2002 Gassauer et al.
6,396,367 B1 5/2002 Rosenberger
D458,904 S 6/2002 Montena
6,406,330 B2 6/2002 Bruce
6,409,534 B1 6/2002 Weisz-Margulescu
D460,739 S 7/2002 Fox
D460,740 S 7/2002 Montena
D460,946 S 7/2002 Montena
D460,947 S 7/2002 Montena
D460,948 S 7/2002 Montena
6,422,884 B1 7/2002 Babasick et al.
6,422,900 B1 7/2002 Hogan
6,425,782 B1 7/2002 Holland
D461,166 S 8/2002 Montena
D461,167 S 8/2002 Montena
D461,778 S 8/2002 Fox
D462,058 S 8/2002 Montena
D462,060 S 8/2002 Fox
6,439,899 B1 8/2002 Muzslay et al.
D462,327 S 9/2002 Montena
6,450,829 B1 9/2002 Weisz-Margulescu
6,454,463 B1 9/2002 Halbach
6,464,526 B1 10/2002 Seufert et al.
6,467,816 B1 10/2002 Huang
6,468,100 B1 10/2002 Meyer et al.
6,491,546 B1 12/2002 Perry
D468,696 S 1/2003 Montena
6,506,083 B1 1/2003 Bickford et al.
6,520,800 B1 2/2003 Michelbach et al.
6,530,807 B2 3/2003 Rodrigues et al.
6,540,531 B2 4/2003 Syed et al.
6,558,194 B2 5/2003 Montena ..... 439/585
6,572,419 B2 6/2003 Feye-Homann
6,576,833 B2 6/2003 Covaro et al.
6,619,876 B2 9/2003 Vaitkus et al.
6,634,906 B1 10/2003 Yeh
6,663,397 B1 12/2003 Lin et al.
6,676,446 B2 1/2004 Montena
6,683,253 B1 1/2004 Lee
6,692,285 B2 2/2004 Islam
6,692,286 B1 2/2004 De Cet
6,695,636 B2 2/2004 Hall et al.
6,705,875 B2 3/2004 Berghorn et al.
6,705,884 B1 3/2004 McCarthy
6,709,280 B1 3/2004 Gretz
6,712,631 B1 3/2004 Youtsey
6,716,041 B2 4/2004 Ferderer et al.
6,716,062 B1 4/2004 Palinkas et al.
6,733,336 B1 5/2004 Montena et al.
6,733,337 B2 5/2004 Kodaira
6,752,633 B2 6/2004 Aizawa et al.
6,761,571 B2 7/2004 Hida
6,767,248 B1 7/2004 Hung
6,769,926 B1 8/2004 Montena
6,780,029 B1 8/2004 Gretz
6,780,042 B1 8/2004 Badescu et al.
6,780,052 B2 8/2004 Montena et al.
6,780,068 B2 8/2004 Bartholoma et al.
6,783,394 B1 8/2004 Holliday
6,786,767 B1 9/2004 Fuks et al.
6,790,081 B2 9/2004 Burris et al.
6,793,528 B2 9/2004 Lin et al.
6,802,738 B1 10/2004 Henningsen
6,805,583 B2 10/2004 Holliday et al.
6,805,584 B1 10/2004 Chen
6,808,415 B1 10/2004 Montena
6,817,272 B2 11/2004 Holland
6,817,896 B2 11/2004 Derenthal
6,817,897 B2 11/2004 Chee
6,827,608 B2 12/2004 Hall et al.
6,830,479 B2 12/2004 Holliday
6,848,115 B2 1/2005 Sugiura et al.
6,848,939 B2 2/2005 Stirling
6,848,940 B2 2/2005 Montena ..... 439/584
6,848,941 B2 2/2005 Wlos et al.
6,884,113 B1 4/2005 Montena
6,884,115 B2 4/2005 Malloy
6,887,102 B1 5/2005 Burris et al.
6,929,265 B2 8/2005 Holland et al.
6,929,508 B1 8/2005 Holland
6,935,866 B2 8/2005 Kerekes et al.
6,939,169 B2 9/2005 Islam et al.
6,942,516 B2 9/2005 Shimoyama et al.
6,942,520 B2 9/2005 Barlian et al.
6,945,805 B1 9/2005 Bollinger
6,948,976 B2 9/2005 Goodwin et al.
6,953,371 B2 10/2005 Baker et al.
6,955,563 B1 10/2005 Croan
6,971,912 B2 12/2005 Montena et al.
7,008,263 B2 3/2006 Holland
7,018,216 B1 3/2006 Clark et al.
7,018,235 B1 3/2006 Burris et al. ..... 439/584
7,029,326 B2 4/2006 Montena
7,063,565 B2 6/2006 Ward
7,070,447 B1 7/2006 Montena
7,077,697 B2 7/2006 Kooiman
7,086,897 B2 8/2006 Montena

(56) References Cited

U.S. PATENT DOCUMENTS

| | | | | |
|---|---|---|---|---|
| 7,090,525 | B1 | 8/2006 | Morana | |
| 7,094,114 | B2 | 8/2006 | Kurimoto | |
| 7,097,499 | B1 | 8/2006 | Purdy | |
| 7,102,868 | B2 | 9/2006 | Montena | |
| 7,112,078 | B2 | 9/2006 | Czikora | |
| 7,112,093 | B1 | 9/2006 | Holland | |
| 7,114,990 | B2 | 10/2006 | Bence et al. | |
| 7,118,285 | B2 | 10/2006 | Fenwick et al. | |
| 7,118,382 | B2 | 10/2006 | Kerekes et al. | |
| 7,118,416 | B2 | 10/2006 | Montena et al. | |
| 7,125,283 | B1 | 10/2006 | Lin | |
| 7,128,604 | B2 | 10/2006 | Hall | |
| 7,131,867 | B1 | 11/2006 | Foster et al. | |
| 7,131,868 | B2 | 11/2006 | Montena | |
| 7,140,645 | B2 | 11/2006 | Cronley | |
| 7,144,271 | B1 | 12/2006 | Burris et al. | |
| 7,147,509 | B1 | 12/2006 | Burris et al. | |
| 7,156,696 | B1 | 1/2007 | Montena | |
| 7,161,785 | B2 | 1/2007 | Chawgo | |
| 7,165,974 | B2 | 1/2007 | Kooiman | |
| 7,173,121 | B2 | 2/2007 | Fang | |
| 7,179,121 | B1 | 2/2007 | Burris et al. | |
| 7,179,122 | B2 | 2/2007 | Holliday | |
| 7,182,639 | B2 | 2/2007 | Burris | 439/584 |
| 7,189,114 | B1 | 3/2007 | Burris et al. | |
| 7,192,308 | B2 | 3/2007 | Rodrigues et al. | |
| 7,229,303 | B2 | 6/2007 | Vermoesen et al. | |
| 7,238,047 | B2 | 7/2007 | Saettele et al. | |
| 7,252,536 | B2 | 8/2007 | Lazaro, Jr. et al. | |
| 7,252,546 | B1 | 8/2007 | Holland | |
| 7,255,598 | B2 | 8/2007 | Montena et al. | |
| 7,261,594 | B2 | 8/2007 | Kodama et al. | |
| 7,264,502 | B2 | 9/2007 | Holland | |
| 7,278,882 | B1 | 10/2007 | Li | |
| 7,288,002 | B2 | 10/2007 | Rodrigues et al. | |
| 7,291,033 | B2 | 11/2007 | Hu | |
| 7,299,550 | B2 | 11/2007 | Montena | |
| 7,318,609 | B2 | 1/2008 | Naito et al. | |
| 7,322,846 | B2 | 1/2008 | Camelio | |
| 7,322,851 | B2 | 1/2008 | Brookmire | |
| 7,329,139 | B2 | 2/2008 | Benham | |
| 7,335,058 | B1 | 2/2008 | Burris et al. | |
| 7,347,129 | B1 | 3/2008 | Youtsey | |
| 7,347,726 | B2 | 3/2008 | Wlos | |
| 7,347,727 | B2 | 3/2008 | Wlos et al. | |
| 7,347,729 | B2 | 3/2008 | Thomas et al. | |
| 7,351,088 | B1 | 4/2008 | Qu | |
| 7,357,641 | B2 | 4/2008 | Kerekes et al. | |
| 7,364,462 | B2 | 4/2008 | Holland | |
| 7,371,112 | B2 | 5/2008 | Burris et al. | |
| 7,375,533 | B2 | 5/2008 | Gale | |
| 7,387,524 | B2 | 6/2008 | Cheng | |
| 7,393,245 | B2 | 7/2008 | Palinkas et al. | |
| 7,396,249 | B2 | 7/2008 | Kauffman | |
| 7,404,737 | B1 | 7/2008 | Youtsey | |
| 7,410,389 | B2 | 8/2008 | Holliday | |
| 7,416,415 | B2 | 8/2008 | Hart et al. | |
| 7,438,327 | B2 | 10/2008 | Auray et al. | 285/151.1 |
| 7,452,239 | B2 | 11/2008 | Montena | |
| 7,455,550 | B1 | 11/2008 | Sykes | |
| 7,458,850 | B1 | 12/2008 | Burris et al. | |
| 7,462,068 | B2 | 12/2008 | Amidon | |
| 7,467,980 | B2 | 12/2008 | Chiu | |
| 7,476,127 | B1 | 1/2009 | Wei | |
| 7,478,475 | B2 | 1/2009 | Hall | |
| 7,479,033 | B1 | 1/2009 | Sykes et al. | |
| 7,479,035 | B2 | 1/2009 | Bence et al. | |
| 7,484,988 | B2 | 2/2009 | Ma et al. | |
| 7,484,997 | B2 | 2/2009 | Hofling | |
| 7,488,210 | B1 | 2/2009 | Burris et al. | |
| 7,494,355 | B2 | 2/2009 | Hughes et al. | |
| 7,497,729 | B1 | 3/2009 | Wei | |
| 7,500,868 | B2 | 3/2009 | Holland et al. | |
| 7,500,873 | B1 | 3/2009 | Hart | |
| 7,507,116 | B2 | 3/2009 | Laerke et al. | |
| 7,507,117 | B2 | 3/2009 | Amidon | |
| 7,513,788 | B2 | 4/2009 | Camelio | |
| 7,544,094 | B1 | 6/2009 | Paglia et al. | |
| 7,563,133 | B2 | 7/2009 | Stein | |
| 7,566,236 | B2 | 7/2009 | Malloy et al. | |
| 7,568,945 | B2 | 8/2009 | Chee et al. | |
| 7,578,693 | B2 | 8/2009 | Yoshida et al. | |
| 7,588,454 | B2 | 9/2009 | Nakata et al. | |
| 7,607,942 | B1 | 10/2009 | Van Swearingen | |
| 7,625,227 | B1 | 12/2009 | Henderson et al. | |
| 7,632,143 | B1 | 12/2009 | Islam | |
| 7,635,283 | B1 | 12/2009 | Islam | |
| 7,651,376 | B2 | 1/2010 | Schreier | |
| 7,674,132 | B1 | 3/2010 | Chen | |
| 7,682,177 | B2 | 3/2010 | Berthet | |
| 7,682,188 | B1 | 3/2010 | Lu | |
| 7,714,229 | B2 | 5/2010 | Burris et al. | |
| 7,727,011 | B2 | 6/2010 | Montena et al. | |
| 7,749,021 | B2 | 7/2010 | Brodeur | |
| 7,753,705 | B2 | 7/2010 | Montena | |
| 7,753,710 | B2 | 7/2010 | George | |
| 7,753,727 | B1 | 7/2010 | Islam et al. | |
| 7,758,370 | B1 | 7/2010 | Flaherty | |
| 7,794,275 | B2 | 9/2010 | Rodrigues | |
| 7,806,714 | B2 | 10/2010 | Williams et al. | |
| 7,806,725 | B1 | 10/2010 | Chen | |
| 7,811,133 | B2 | 10/2010 | Gray | |
| D626,920 | S | 11/2010 | Purdy et al. | |
| 7,824,216 | B2 | 11/2010 | Purdy | |
| 7,828,595 | B2 | 11/2010 | Mathews | |
| 7,830,154 | B2 | 11/2010 | Gale | |
| 7,833,053 | B2 | 11/2010 | Mathews | |
| 7,845,976 | B2 | 12/2010 | Mathews | |
| 7,845,978 | B1 | 12/2010 | Chen | |
| 7,845,980 | B1 | 12/2010 | Amidon | |
| 7,850,472 | B2 | 12/2010 | Friedrich et al. | |
| 7,850,487 | B1 | 12/2010 | Wei | |
| 7,857,661 | B1 | 12/2010 | Islam | |
| 7,874,870 | B1 | 1/2011 | Chen | |
| 7,887,354 | B2 | 2/2011 | Holliday | |
| 7,892,004 | B2 | 2/2011 | Hertzler et al. | |
| 7,892,005 | B2 | 2/2011 | Haube | |
| 7,892,024 | B1 | 2/2011 | Chen | |
| 7,914,326 | B2 | 3/2011 | Sutter | 439/584 |
| 7,918,687 | B2 | 4/2011 | Paynter et al. | |
| 7,927,135 | B1 | 4/2011 | Wlos | |
| 7,934,955 | B1 | 5/2011 | Hsia | |
| 7,942,695 | B1 | 5/2011 | Lu | |
| 7,950,958 | B2 | 5/2011 | Mathews | |
| 7,955,126 | B2 | 6/2011 | Bence et al. | |
| 7,972,158 | B2 | 7/2011 | Wild et al. | |
| 7,972,176 | B2 | 7/2011 | Burris et al. | |
| 7,982,005 | B2 | 7/2011 | Ames et al. | |
| 8,011,955 | B1 | 9/2011 | Lu | |
| 8,025,518 | B2 | 9/2011 | Burris et al. | 439/322 |
| 8,029,315 | B2 | 10/2011 | Purdy et al. | |
| 8,029,316 | B2 | 10/2011 | Snyder et al. | |
| 8,062,044 | B2 | 11/2011 | Montena et al. | |
| 8,062,063 | B2 | 11/2011 | Malloy et al. | |
| 8,070,504 | B2 | 12/2011 | Amidon et al. | |
| 8,075,337 | B2 | 12/2011 | Malloy et al. | |
| 8,075,338 | B1 | 12/2011 | Montena | |
| 8,079,860 | B1 | 12/2011 | Zraik | |
| 8,087,954 | B2 | 1/2012 | Fuchs | |
| 8,113,875 | B2 * | 2/2012 | Malloy et al. | 439/578 |
| 8,157,587 | B2 | 4/2012 | Paynter et al. | |
| 8,157,588 | B1 | 4/2012 | Rodrigues et al. | |
| 8,167,636 | B1 | 5/2012 | Montena | |
| 8,172,612 | B2 | 5/2012 | Bence et al. | |
| 8,177,572 | B2 | 5/2012 | Feye-Hohmann | |
| 8,192,237 | B2 | 6/2012 | Purdy et al. | |
| 8,206,172 | B2 | 6/2012 | Katagiri et al. | |
| D662,893 | S | 7/2012 | Haberek et al. | |
| 8,231,412 | B2 | 7/2012 | Paglia et al. | |
| 8,262,408 | B1 | 9/2012 | Kelly | |
| 8,272,893 | B2 | 9/2012 | Burris et al. | |
| 8,287,320 | B2 | 10/2012 | Purdy et al. | |
| 8,313,345 | B2 | 11/2012 | Purdy | |
| 8,313,353 | B2 | 11/2012 | Purdy et al. | |

(56) References Cited

U.S. PATENT DOCUMENTS 8,317,539 B2 11/2012 Stein
8,323,053 B2 12/2012 Montena
8,323,058 B2 12/2012 Flaherty et al.
8,323,060 B2 12/2012 Purdy et al.
8,337,229 B2 12/2012 Montena
8,376,769 B2 2/2013 Holland et al.
D678,844 S 3/2013 Haberek
8,398,421 B2 3/2013 Haberek et al.
8,449,326 B2 5/2013 Holland et al.
8,469,739 B2 6/2013 Rodrigues et al.
D686,164 S 7/2013 Haberek et al.
D686,576 S 7/2013 Haberek et al.
8,480,430 B2 7/2013 Ehret et al.
8,506,325 B2 8/2013 Malloy et al.
8,517,763 B2 8/2013 Burris et al.
8,517,764 B2 8/2013 Wei et al.
8,529,279 B2 9/2013 Montena
8,550,835 B2 10/2013 Montena
8,568,163 B2 10/2013 Burris et al.
8,568,165 B2 10/2013 Wei et al.
8,591,244 B2 11/2013 Thomas et al.
8,597,050 B2 12/2013 Flaherty et al.
8,636,529 B2 1/2014 Stein
8,647,136 B2 2/2014 Purdy et al.
8,690,603 B2 4/2014 Bence et al.
8,721,365 B2 5/2014 Holland
8,727,800 B2 5/2014 Holland et al.
8,777,658 B2 7/2014 Holland et al.
8,777,661 B2 7/2014 Holland et al.
8,858,251 B2 10/2014 Montena
8,888,526 B2 11/2014 Burris
8,920,192 B2 12/2014 Montena
2001/0034143 A1 10/2001 Annequin
2001/0046802 A1 11/2001 Perry et al.
2001/0051448 A1 12/2001 Gonzalez
2002/0013088 A1 1/2002 Rodrigues et al.
2002/0019161 A1 2/2002 Finke et al.
2002/0038720 A1 4/2002 Kai et al.
2002/0146935 A1 10/2002 Wong
2003/0110977 A1 6/2003 Batlaw
2003/0119358 A1 6/2003 Henningsen
2003/0139081 A1 7/2003 Hall et al.
2003/0194890 A1 10/2003 Ferderer et al.
2003/0214370 A1 11/2003 Allison et al.
2003/0224657 A1 12/2003 Malloy
2004/0031144 A1 2/2004 Holland
2004/0077215 A1 4/2004 Palinkas et al.
2004/0102089 A1 5/2004 Chee
2004/0157499 A1 8/2004 Nania et al.
2004/0194585 A1 10/2004 Clark
2004/0209516 A1 10/2004 Burris et al.
2004/0219833 A1 11/2004 Burris et al.
2004/0229504 A1 11/2004 Liu
2005/0042919 A1 2/2005 Montena
2005/0079762 A1 4/2005 Hsia
2005/0159045 A1 7/2005 Huang
2005/0170692 A1 8/2005 Montena
2005/0181652 A1 8/2005 Montena et al.
2005/0181668 A1 8/2005 Montena et al.
2005/0208827 A1 9/2005 Burris et al.
2005/0233636 A1 10/2005 Rodrigues et al.
2005/0277330 A1* 12/2005 Kisling et al. ..... 439/578
2006/0014425 A1 1/2006 Montena
2006/0099853 A1 5/2006 Sattele et al.
2006/0110977 A1 5/2006 Matthews
2006/0154519 A1 7/2006 Montena
2006/0166552 A1 7/2006 Bence et al.
2006/0178046 A1 8/2006 Tusini
2006/0194465 A1 8/2006 Czikora
2006/0223355 A1 10/2006 Hirschmann
2006/0246774 A1 11/2006 Buck
2006/0258209 A1 11/2006 Hall
2006/0276079 A1 12/2006 Chen
2007/0004276 A1 1/2007 Stein
2007/0015406 A1* 1/2007 Chawgo ..... 439/578
2007/0026734 A1 2/2007 Bence et al.
2007/0049113 A1 3/2007 Rodrigues et al.
2007/0054535 A1 3/2007 Hall et al.
2007/0059968 A1 3/2007 Ohtaka et al.
2007/0082533 A1 4/2007 Currier et al.
2007/0087613 A1 4/2007 Schumacher et al.
2007/0123101 A1 5/2007 Palinkas
2007/0155232 A1 7/2007 Burris et al.
2007/0173100 A1 7/2007 Benham
2007/0175027 A1 8/2007 Khemakhem et al.
2007/0232117 A1 10/2007 Singer
2007/0243759 A1 10/2007 Rodrigues et al.
2007/0243762 A1 10/2007 Burke et al.
2007/0287328 A1 12/2007 Hart et al.
2008/0032556 A1 2/2008 Schreier
2008/0102696 A1 5/2008 Montena
2008/0171466 A1 7/2008 Buck et al.
2008/0200066 A1 8/2008 Hofling
2008/0200068 A1 8/2008 Aguirre
2008/0207051 A1* 8/2008 Montena ..... 439/578
2008/0214040 A1 9/2008 Holterhoff et al.
2008/0289470 A1 11/2008 Aston
2009/0029590 A1 1/2009 Sykes et al.
2009/0098770 A1 4/2009 Bence et al.
2009/0104801 A1 4/2009 Silva
2009/0163075 A1 6/2009 Blew et al.
2009/0186505 A1 7/2009 Mathews
2009/0264003 A1 10/2009 Hertzler et al.
2009/0305560 A1 12/2009 Chen
2010/0007441 A1 1/2010 Yagisawa et al.
2010/0022125 A1 1/2010 Burris et al.
2010/0028563 A1 2/2010 Ota
2010/0055978 A1 3/2010 Montena
2010/0080563 A1 4/2010 DiFonzo et al.
2010/0081321 A1 4/2010 Malloy et al.
2010/0081322 A1 4/2010 Malloy et al.
2010/0087071 A1 4/2010 DiFonzo et al.
2010/0105246 A1 4/2010 Burris et al.
2010/0124839 A1 5/2010 Montena
2010/0130060 A1 5/2010 Islam
2010/0178799 A1 7/2010 Lee
2010/0216339 A1 8/2010 Burris et al.
2010/0233901 A1 9/2010 Wild et al.
2010/0233902 A1 9/2010 Youtsey
2010/0233903 A1 9/2010 Islam
2010/0255719 A1 10/2010 Purdy
2010/0255721 A1* 10/2010 Purdy et al. ..... 439/583
2010/0279548 A1 11/2010 Montena et al.
2010/0297871 A1 11/2010 Haube
2010/0297875 A1 11/2010 Purdy et al.
2010/0304579 A1 12/2010 Kisling
2010/0323541 A1 12/2010 Amidon et al.
2011/0021072 A1 1/2011 Purdy
2011/0021075 A1 1/2011 Orner et al.
2011/0027039 A1 2/2011 Blair
2011/0039448 A1 2/2011 Stein
2011/0053413 A1 3/2011 Mathews
2011/0074388 A1 3/2011 Bowman
2011/0080158 A1 4/2011 Lawrence et al.
2011/0111623 A1 5/2011 Burris et al.
2011/0111626 A1 5/2011 Paglia et al.
2011/0117774 A1 5/2011 Malloy et al.
2011/0143567 A1 6/2011 Purdy et al.
2011/0151714 A1 6/2011 Flaherty et al.
2011/0230089 A1 9/2011 Amidon et al.
2011/0230091 A1 9/2011 Krenceski et al.
2011/0237123 A1 9/2011 Burris et al.
2011/0237124 A1 9/2011 Flaherty et al.
2011/0250789 A1 10/2011 Burris et al.
2011/0318958 A1 12/2011 Burris et al.
2012/0021642 A1 1/2012 Zraik
2012/0028499 A1* 2/2012 Zraik ..... 439/584
2012/0040537 A1 2/2012 Burris
2012/0045933 A1 2/2012 Youtsey
2012/0064768 A1 3/2012 Islam et al.
2012/0094518 A1* 4/2012 Mathews ..... 439/275
2012/0094530 A1 4/2012 Montena
2012/0100751 A1 4/2012 Montena
2012/0108098 A1 5/2012 Burris et al.

(56) References Cited

U.S. PATENT DOCUMENTS

| | | | | |
|---|---|---|---|---|
| 2012/0122329 | A1 | 5/2012 | Montena | |
| 2012/0129387 | A1 | 5/2012 | Holland et al. | |
| 2012/0171894 | A1 | 7/2012 | Malloy et al. | |
| 2012/0178289 | A1 | 7/2012 | Holliday | |
| 2012/0202378 | A1 | 8/2012 | Krenceski et al. | |
| 2012/0222302 | A1 | 9/2012 | Purdy et al. | |
| 2012/0225581 | A1 | 9/2012 | Amidon et al. | |
| 2012/0244748 | A1* | 9/2012 | Purdy | 439/578 |
| 2012/0315788 | A1 | 12/2012 | Montena | |
| 2013/0065433 | A1 | 3/2013 | Burris | |
| 2013/0072057 | A1 | 3/2013 | Burris | |
| 2013/0178096 | A1 | 7/2013 | Matzen | |
| 2014/0106612 | A1 | 4/2014 | Burris | |
| 2014/0106613 | A1 | 4/2014 | Burris | |
| 2014/0148051 | A1 | 5/2014 | Bence et al. | |

FOREIGN PATENT DOCUMENTS

| | | |
|---|---|---|
| CN | 201149937 | 11/2008 |
| CN | 201178228 | 1/2009 |
| CN | 201904508 | 7/2011 |
| DE | 47931 | 10/1888 |
| DE | 102289 | 7/1897 |
| DE | 1117687 | 11/1961 |
| DE | 2261973 | 6/1974 |
| DE | 3211008 | 10/1983 |
| DE | 9001608.4 | 4/1990 |
| DE | 4439852 | 5/1996 |
| DE | 19957518 | 9/2001 |
| EP | 116157 | 8/1984 |
| EP | 167738 | 1/1986 |
| EP | 72104 | 2/1986 |
| EP | 265276 | 4/1988 |
| EP | 428424 | 5/1991 |
| EP | 1191268 | 3/2002 |
| EP | 1501159 | 1/2005 |
| EP | 1548898 | 6/2005 |
| EP | 1603200 | 12/2005 |
| EP | 1701410 | 9/2006 |
| EP | 2051340 | 4/2009 |
| FR | 2232846 | 1/1975 |
| FR | 2462798 | 2/1981 |
| FR | 2494508 | 2/1982 |
| GB | 589697 | 6/1947 |
| GB | 1087228 | 10/1967 |
| GB | 1270846 | 4/1972 |
| GB | 1332888 | 10/1973 |
| GB | 1401373 | 7/1975 |
| GB | 1421215 | 1/1976 |
| GB | 2019665 | 10/1979 |
| GB | 2079549 | 1/1982 |
| GB | 2252677 | 8/1992 |
| GB | 2264201 | 8/1993 |
| GB | 2331634 | 5/1999 |
| GB | 2448595 | 10/2008 |
| GB | 2450248 | 12/2008 |
| JP | 3280369 | 12/1991 |
| JP | 200215823 | 1/2002 |
| JP | 4503793 | 7/2010 |
| KR | 100622526 | 9/2006 |
| TW | 427044 | 3/2001 |
| WO | 8700351 | 1/1987 |
| WO | 0186756 | 11/2001 |
| WO | 02069457 | 9/2002 |
| WO | 2004013883 | 2/2004 |
| WO | 2006081141 | 8/2006 |
| WO | 2007062845 | 6/2007 |
| WO | 2009066705 | 5/2009 |
| WO | 2010135181 | 11/2010 |
| WO | 2011057033 | 5/2011 |
| WO | 2012162431 | 5/2011 |
| WO | 2011128665 | 10/2011 |
| WO | 2011128666 | 10/2011 |
| WO | 2013126629 | 8/2013 |

OTHER PUBLICATIONS

Office Action dated Aug. 25, 2014 pertaining to U.S. Appl. No. 13/605,481.

Election/Restrictions Requirement dated Jul. 31, 2014 pertaining to U.S. Appl. No. 13/652,969.

Office Action dated Aug. 29, 2014 pertaining to U.S. Appl. No. 13/827,522.

Election/Restrictions Requirement dated Jun. 20, 2014 pertaining to U.S. Appl. No. 13/795,780.

Office Action dated Sep. 19, 2014 pertaining to U.S. Appl. No. 13/795,780.

Office Action dated Oct. 6, 2014 pertaining to U.S. Appl. No. 13/732,679.

Corning Cabelcon waterproof CX3 7.0 QuickMount for RG6 cables; Cabelcon Connectors; www.cabelcom.dk; Mar. 15, 2012.

Maury Jr., M.; Microwave Coaxial Connector Technology: A Continuaing Evolution; Maury Microwave Corporation; Dec. 13, 2005; pp. 1-21; Maury Microwave Inc.

"Snap-On/Push-On" SMA Adapter; RF TEC Mfg., Inc.; Mar. 23, 2006; 2 pgs.

RG6 quick mount data sheet; Corning Cabelcon; 2010; 1 pg.; Corning Cabelcon ApS.

RG11 quick mount data sheet; Corning Cabelcon; 2013; 1 pg.; Corning Cabelcon ApS.

Gilbert Engineering Co., Inc.; OEM Coaxial Connectors catalog; Aug. 1993; p. 26.

UltraEase Compression Connectors; "F" Series 59 and 6 Connectors Product Information; May 2005; 4 pgs.

Pomona Electronics Full Line Catelog; vol. 50; 2003; pp. 1-100.

Corning Gilbert 2004 OEM Coaxial Products Catalog, Quick Disconnects, 2 pages.

Digicon AVL Connector. ARRIS Group Inc. [online] 3 pages. Retrieved from the Internet: <URL: http://www.arrisi.com/special/digiconAVL.asp.

US Office Action, U.S. Appl. No. 10/997,218; Jul. 31, 2006, pp. 1-10.

Society of Cable Telecommunications Engineers, Engineering Committee, Interface Practices Subcommittee; American National Standard; ANSI/SCTE 01 2006; Specification for "F" Port, Female, Outdoor. Published Jan. 2006. 9 pages.

The American Society of Mechanical Engineers; "Lock Washers (Inch Series), An American National Standard"; ASME 818.21.1-1999 (Revision of ASME B18.21.1-1994); Reaffirmed 2005. Published Feb. 11, 2000. 28 pages.

U.S. Reexamination Control No. 90/012,300 filed Jun. 29, 2012, regarding U.S. Patent No. 8,172,612 filed May 27, 2011 (Bence et al.).

U.S. Reexamination Control No. 90/012,749 filed Dec. 21, 2012, regarding U.S. Patent No. 7,114,990, filed Jan. 25, 2005 (Bence et al.).

U.S. Reexamination Control No. 90/012,835 filed Apr. 11, 2013, regarding U.S. Patent No. 8,172,612 filed May 27, 2011 (Bence et al.).

Notice of Allowance (Mail Date Mar. 20, 2012) for U.S. Appl. No. 13/117,843.

Search Report dated Jun. 6, 2014 pertaining to International application No. PCT/US2014/023374.

Search Report dated Apr. 9, 2014 pertaining to International application No. PCT/US2014/015934.

Society of Cable Telecommunications Engineers, Engineering Committee, Interface Practices Subcommittee; American National Standard; ANSI/SCTE 02 2006; "Specification for "F" Port, Female, Indoor". Published Feb. 2006. 9 pages.

PPC, "Next Generation Compression Connectors," pp. 1-6, Retrieved from http://www.tessco.com/yts/partnearnanufacturer list/vendors/ppc/pdf/ppc digital spread.pdf.

Patent Cooperation Treaty, International Search Report for PCT/US2013/070497, Feb. 11, 2014, 3 pgs.

Patent Cooperation Treaty, International Search Report for PCT/US2013/064515, 10 pgs.

Patent Cooperation Treaty, International Search Report for PCT/US2013/064512, Jan. 21, 2014, 11 pgs.

Huber+Suhner AG, RF Connector Guide: Understanding connector

(56) References Cited

OTHER PUBLICATIONS technology, 2007, Retrieved from http://www.ie.itcr.ac.cr/marin/lic/e14515/HUBER+SUENER_RF_Connector_Guide.pdf.
Slade, Paul G,. Electrical Contacts: Principles and Applications, 1999, Retrieved from http://books.google.com/books (table of contents only).
U.S. Reexamination Control No. 95/002,400 filed Sep. 15, 2012, regarding U.S. Patent No. 8,192,237 filed Feb. 23, 2011 (Purdy et al.).
U.S. Reexamination Control No. 90/013,068 filed Nov. 27, 2013, regarding U.S. Patent No. 6,558,194 filed Jul. 21, 2000 (Montena).
U.S. Reexamination Control No. 90/013,069 filed Nov. 27, 2013, regarding U.S. Patent No. 6,848,940 filed Jan. 21, 2003 (Montena).
U.S. Inter Partes Review Case No. 2013-00346 filed Jun. 10, 2013, regarding U.S. Patent No. 8,287,320 filed Dec. 8, 2009, claims 1-8, 10-16, 18-31 (Purdy et al.).
U.S. Inter Partes Review Case No. 2013-00343 filed Jun. 10, 2013, regarding U.S. Patent No. 8,313,353 filed Apr. 30, 2012, claims 1-6 (Purdy et al.).
U.S. Inter Partes Review Case No. 2013-00340 filed Jun. 10, 2013, regarding U.S. Patent No. 8,323,060 filed Jun. 14, claims 1-9 (Purdy et al.).
U.S. Inter Partes Review Case No. 2013-00347 filed Jun. 10, 2013, regarding U.S. Patent No. 8,287,320 filed Dec. 8, 2009, claims 9, 17, 32 (Purdy et al.).
U.S. Inter Partes Review Case No. 2013-00345 filed Jun. 10, 2013, regarding U.S. Patent No. 8,313,353 filed Apr. 30, 2012, claims 7-27 (Purdy et al.).
U.S. Inter Partes Review Case No. 2013-00342 filed Jun. 10, 2013, regarding U.S. Patent No. 8,323,060 filed Jun. 14, 2012, claims 10-25 (Purdy et al.).
U.S. Inter Partes Review Case No. 2014-00441 filed Feb. 18, 2014, regarding U.S. Patent No. 8,562,366 filed Oct. 15, 2012, claims 31,37, 39, 41, 42, 55 56 (Purdy et al.).
U.S. Inter Partes Review Case No. 2014-00440 filed Feb. 18, 2014, regarding U.S. Patent No. 8,597,041 filed Oct. 15, 2012, claims 1, 8, 9, 11, 18-26, 29 (Purdy et al.).
Office Action dated Dec. 31, 2014 pertaining to U.S. Appl. No. 13/605,498.
Office Action dated Dec. 16, 2014 pertaining to U.S. Appl. No. 13/653,095.
Office Action dated Dec. 19, 2014 pertaining to U.S. Appl. No. 13/652,969.
Office Action dated Dec. 29, 2014 pertaining to U.S. Appl. No. 13/833,793.
Notice of Allowance dated Feb. 2, 2015 pertaining to U.S. Appl. No. 13/795,737.
Office Action dated Feb. 25, 2015 pertaining to U.S. Appl. No. 13/605,481.
Office Action dated Feb. 18, 2015 pertaining to U.S. Appl. No. 13/827,522.

* cited by examiner

COAXIAL CABLE CONNECTOR HAVING A GRIPPING MEMBER WITH A NOTCH AND DISPOSED INSIDE A SHELL

RELATED APPLICATIONS

This application claims the benefit of priority under 35 U.S.C. 119 of U.S. Provisional Application Ser. No. 61/896,355 filed on Oct. 28, 2013, the content of which is relied upon and incorporated herein by reference in its entirety.

BACKGROUND

1. Field

The disclosure relates generally to coaxial cable connectors, and particularly to coaxial cable connectors capable of being connected to a terminal.

2. Technical Background

Coaxial cable connectors such as F-connectors are used to attach coaxial cable to another object such as an appliance or junction having a terminal adapted to engage the connector. Coaxial cable F-connectors are often used to terminate a drop cable in a cable television system. The coaxial cable typically includes a center conductor surrounded by a dielectric, in turn surrounded by a conductive grounding foil and/or braid (hereinafter referred to as a conductive grounding sheath); the conductive grounding sheath is itself surrounded by a protective outer jacket. The F-connector is secured over the prepared end of the jacketed coaxial cable, allowing the end of the coaxial cable to be connected with a terminal block, such as by a threaded connection with a threaded terminal of a terminal block.

Securing an F-connector to a coaxial cable requires the application of a direct axial compression force to the F-connector. While a compound leverage compression tool is used in the field to enable technicians to secure the F-connector, it would be desirable for connector installers to have a coaxial connector requiring lower axial compression force but maintaining current functional standards such as environmental sealing, RF performance and mechanical performance.

SUMMARY

Embodiments disclosed herein include a gripping member for a coaxial cable connector. The gripping member has a front end and a rear end opposite the front end, and an outer surface and an inner surface defining a longitudinal hole extending between the front end and the rear end. A first portion of the gripping member terminates at the front end. A second portion of the gripping member terminates at the rear end and includes at least one notch which extends from the inner surface of second portion to a certain depth from inner surface. The gripping member is configured to be forced under a body of a coaxial cable connector when driven axially forward by a shell of a coaxial cable connector to secure a coaxial cable to the connector.

Embodiments disclosed herein include a connector for coupling an end of a coaxial cable to a terminal. The coaxial cable has an inner conductor, a dielectric surrounding the inner conductor, an outer conductor surrounding the dielectric, a braided shield surrounding the dielectric, and a jacket surrounding the braided shield. The connector has a body, a shell, a post and a gripping member. The body has a rear end, a front end, and an internal surface extending between the rear and front ends of the body, the internal surface defining a longitudinal hole. The shell has a rear end, a front end surrounding at least a portion of the body, and an inner surface defining a longitudinal hole extending between the rear and front ends of the shell, the shell being axially movable over an outside portion the body between a rearward position and a forward position. The post is disposed at least partially within the longitudinal hole of the body, and has a rear end, an inner surface and an outer surface. The outer surface of the post and the internal surface of the post defines an annular cavity between the post and body, The gripping member is disposed within the longitudinal hole of the shell between the front and rear ends thereof and has a front end, a rear end, an outer surface, an inner surface defining an opening therein, a first portion adjacent the front end, and a second portion adjacent the rear end. The second portion has at least one notch which extends from the inner surface of second portion to a certain depth from inner surface. The gripping member is configured to secure a coaxial cable to a coaxial cable connector.

Additional features and advantages will be set forth in the detailed description which follows, and in part will be readily apparent to those skilled in the art from the description or recognized by practicing the embodiments as described in the written description and claims hereof, as well as the appended drawings.

It is to be understood that both the foregoing general description and the following detailed description are merely exemplary, and are intended to provide an overview or framework to understand the nature and character of the claims.

The accompanying drawings are included to provide a further understanding, and are incorporated in and constitute a part of this specification. The drawings illustrate one or more embodiment(s), and together with the description serve to explain principles and operation of the various embodiments.

DETAILED DESCRIPTION

Figure 1:
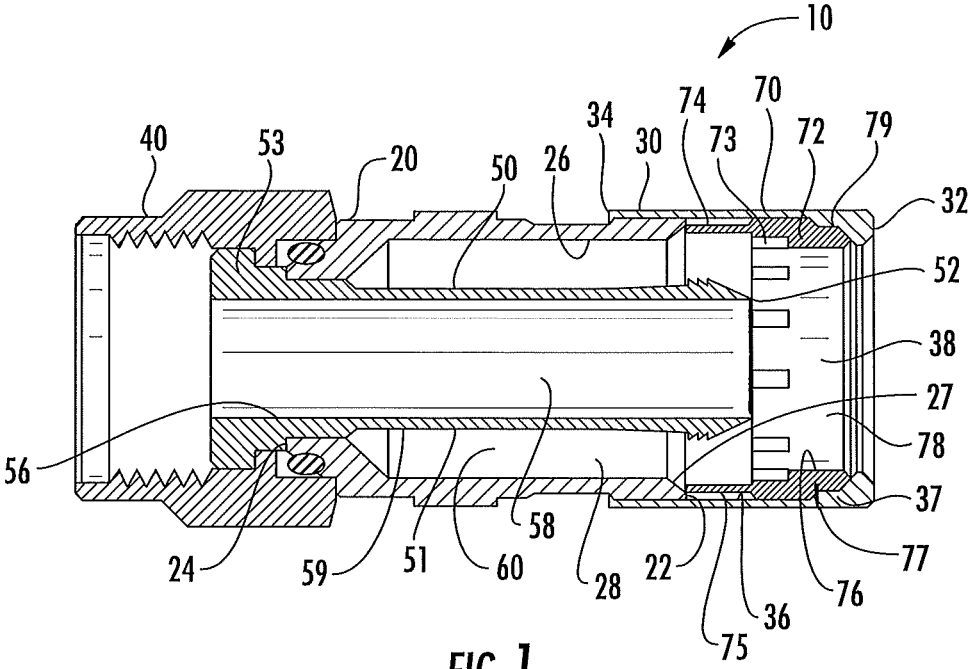
FIG. 1 is a side cutaway view of an exemplary embodiment of a connector, as disclosed herein, comprising a gripping member and a shell with a forward facing tapered portion in a rearward position.

Embodiments disclosed herein include a gripping member for a coaxial cable connector. The coaxial cable connector is used to connect a coaxial cable to an equipment port or terminal such that secure mechanical and electrical connections result. The terms “equipment port” and “terminal” may be used interchangeably herein. It should be understood that each of these terms shall mean or refer to any device or structure to which the coaxial cable connector attaches to mechanically and/or electrically connect a coaxial cable thereto. The coaxial cable connector includes attachment feature for attaching the coaxial cable connector to the equipment port or terminal. The attachment feature may be any suitable attachment device, including, without limitation, rotatable coupler, also referred to as a nut, or push-on component. A body is secured to the coupler at one end in a manner so that it does not rotate with coupler. A post is secured to and inside of the body. Shell is movably attached to body at another end such that shell can axially move toward coupler. Gripping member is frictionally fit inside of shell. Shell accepts the coaxial cable which is inserted through shell and gripping member and is secured to an end of post so that coaxial cable positions between post and body inside of body. Gripping member is configured to secure coaxial cable to coaxial cable connector. In this regard, when an axially compressive force is applied to shell to move shell axially toward coupler, gripping member also moves and at least a part of gripping member is forced between body and coaxial cable.

Gripping member has a front end and a rear end opposite the front end, and an outer surface and an inner surface defining a longitudinal hole extending between the front end and the rear end. A first portion of the gripping member terminates at front end. A second portion of the gripping member terminates at rear end and includes at least one notch which extends from inner surface of second portion to a certain depth from inner surface. The gripping member is configured to secure coaxial cable to coaxial cable connector. Gripping member secures coaxial cable to coaxial cable connector when at least part of the gripping member is forced under body. The gripping member may be forced under body of a coaxial cable connector when driven axially forward by shell to secure coaxial cable to the connector. When forced under the body, gripping member may be displaced radially inwardly, including, without limitation, the first portion and/or the second portion displaced radially inwardly.

Coaxial cable has a center or inner conductor that is surrounded by a dielectric layer. The dielectric layer (or dielectric) may also have a foil or other metallic covering. Coaxial cable then has a braided outer conductor which is covered and protected by a jacket. Typically, to prepare the coaxial cable for attachment to a coaxial cable connector, a portion of the center conductor is exposed. The jacket is trimmed back so that a portion of the dielectric (and metallic covering) and braided outer conductor are exposed. The braided outer conductor is then folded back over the jacket, to expose the dielectric (and the metallic covering if present). Whenever possible, the same reference numerals will be used throughout the drawings to refer to the same or like parts.

Referring now to the figures, FIG. 1 schematically illustrates an embodiment of connector 10 for coupling an end of a coaxial cable to a terminal (not shown). Connector 10 comprises body 20 with shell 30 disposed at rear end of body 20, coupler 40 disposed at, near or proximate front end of body 20, post 50 disposed at least partially within body 20, and gripping member 70 disposed between body 20 and shell 30. Gripping member 70 may be made from any suitable deformable material, such as plastic, for example acetal, or such as soft metal or alloy, for example lead. Body 20, shell 30, and coupler 40 may be made from any suitable material including a corrosion resistant material, for example nickel plated brass. Post 50 may be made from any suitable electrically conductive material, including a metal, for example tin-plated brass.

Body 20 comprises rear end 22, front end 24, and internal surface 26 extending between rear and front ends 22, 24 of body 20. Internal surface 26 defines longitudinal hole 28. Shell 30 comprises rear end 32, front end 34 surrounding and contacting body 20, and inner surface 36 defining longitudinal hole 38 extending between rear and front ends 32, 34 of shell 30.

Post 50 is disposed at least partially within longitudinal hole 28 of body 20. Post 50 comprises outer surface 59 and inner surface 56, wherein post 50 comprises flange 53 and tubular shank 51 having rear end 52, wherein at least rear end 52 is disposed within longitudinal hole 28 of body 20, and wherein outer surface 57 of tubular shank 51 and internal surface 26 of body 20 define an annular cavity 60 there between. Post 50 has inner surface 56, which defines longitudinal hole 58 extending from rear end 52 to front end 54.

Figure 2:
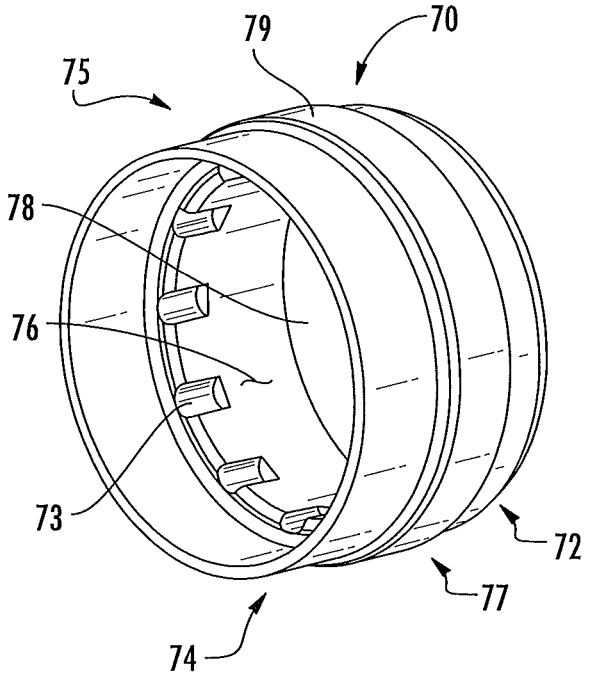
FIG. 2 is a detail, front perspective view of an exemplary embodiment of the gripping member in the connector of FIG. 1.

Continuing to refer to FIG. 1, and now also, briefly to FIG. 2, which shows a perspective, detail view of gripping member 70, gripping member 70 is disposed to inner surface 36 of the shell 30. Gripping member 70 includes rear end 72 proximate rear end 32 of shell 30, front end 74 proximate body 20, outer surface 79 for contacting inner surface 36 of shell 30, and inner surface 76 defining longitudinal hole 78. Gripping member 70 has a first portion 75 that terminates at the front end 74 and a second portion 77 that terminates at the rear end 72. Additionally, gripping member 70 has at least one notch 73 extending from the inner surface 76 of second portion 77. In FIG. 2, a plurality of notches 73 is shown. Notches 73 extend to a certain depth in second portion 77 from inner surface 76. Although in FIG. 2 notches 73 do not extend through second portion 77 to outer surface 79, notches 73 may be constructed so as to extend from inner surface 76 to and/or through outer surface 79.

With reference to FIG. 1, shell 30 is axially moveable with respect to the body 20 between a rearward or disengaged position (to the right in FIG. 1) and forward or engaged position (to the left in FIG. 1). In FIG. 1, shell 30 is shown in rearward or disengaged position. When shell 30 is in the rearward position, front end 74 of gripping member 70 is aligned within the boundaries of rearward facing tapered portion 27 of rear end 22 of body 20. Front end 74 of gripping member 70 may contact rearward facing tapered portion 27 when shell 30 is in the rearward position, but that is not necessary. Rearward facing tapered portion 27 is configured to displace front end 74 of gripping member 70 radially inward. In this regard, front end 74 of gripping member 70 may contact rearward facing tapered portion 27 upon shell 30 moving forward. In this way, gripping member 70 may be maintained in concentric orientation with the longitudinal hole 28. However, as mentioned above, front end 74 of gripping member 70 need not contact rearward facing tapered portion 27. Alternatively or additionally, front end 74 of gripping member 70 could simply be disposed forward of rear end 22 of body 20. The rear end 72 of the gripping member 70 may be press fit with inner surface 36 of shell 30, i.e. the gripping member 70 is mounted onto inner surface 36 of shell 30 by press fit. In other embodiments, gripping member 70 may be mounted onto inner surface 36 of the shell 30 by adhesive.

Figure 3:
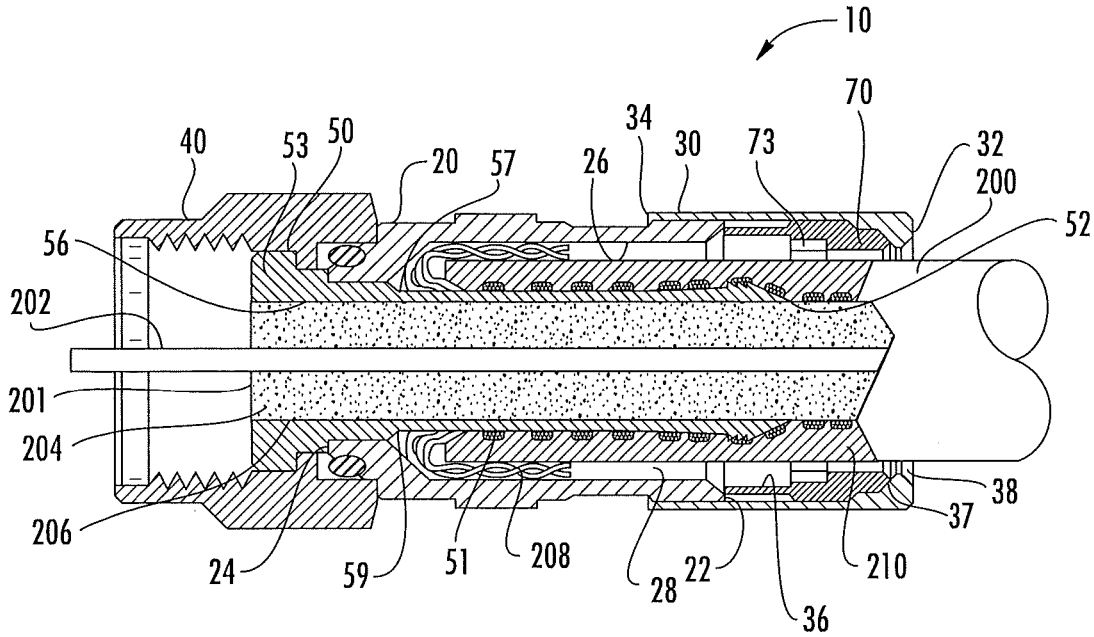
FIG. 3 is a side cutaway view of the connector of FIG. 1 with a coaxial cable shown inserted and the gripping member and shell in a rearward position.
Figure 4:
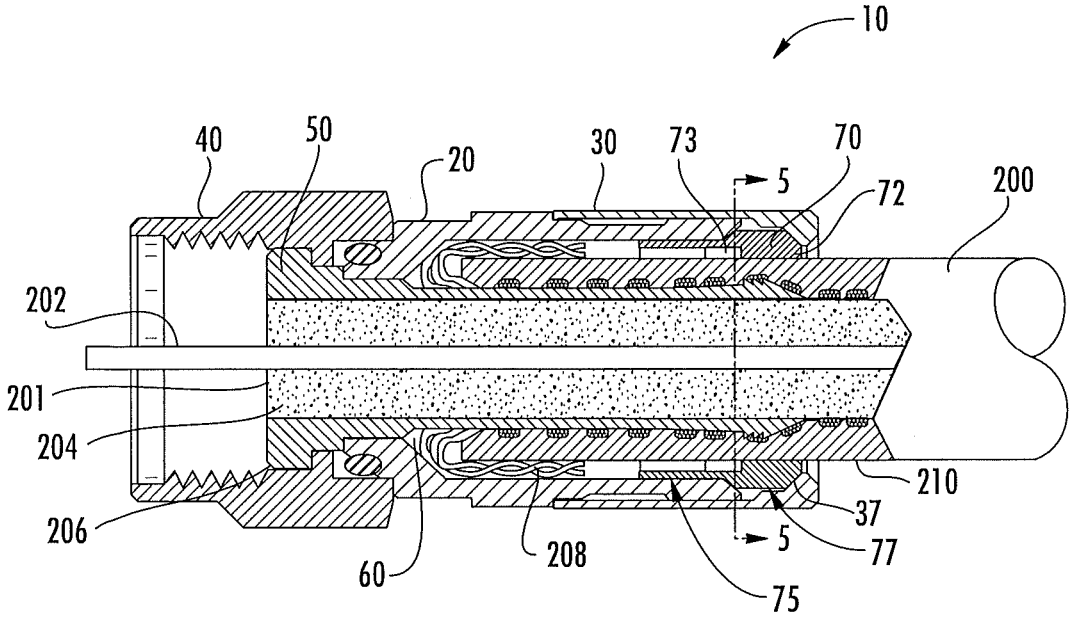
FIG. 4 is a side cutaway view of the connector of FIG. 3 with the gripping member and shell in the forward position.

Referring now to FIGS. 3 and 4, coaxial cable 200 is shown inserted into connector 10. In FIG. 3, connector 10 is shown in disengaged position with shell 30 in a rearward position. In FIG. 4 connector 10 is shown in engaged position with shell 30 in the forward position. Disengaged position may also be referred to as the open position, while engaged position may also be referred to as the closed positioned. Coaxial cable 200 comprises an inner conductor 202, dielectric layer (or, simply, dielectric) 204 surrounding the inner conductor 202, outer conductor 206 and braided shield 208 surrounding the dielectric 204, and jacket 210 surrounding braided shield 208. Coaxial cable 200 enters connector 10 at rear end 32 of shell 30, passes through the longitudinal hole 78 of gripping member 70 and is fit onto rear end 52 of the shank 51 of post 50. Rear end 52 of post 50 is driven between braided shield 208 and outer conductor 206 of coaxial cable 200, until dielectric 204 at end 201 of cable 200 is flush with front end 54 of post 50. Inner conductor 202 and dielectric 204 insert in longitudinal hole 58 in post 50.

Referring in particularly now to FIG. 4, as shell 30 and post 50 are moved together axially by tool (not shown) front end 34 of shell 30 moves over an outside portion of body 20, causing gripping member 70 to move axially forward toward body 20 as well. First portion 75 of the gripping member 70 is displaced radially inward by interaction with rearward facing tapered portion 27 and first portion 75 is disposed in the annular cavity 60 between body 20 and post 50. As can be seen, first portion 75 of the gripping member 70 is fully disposed in the annular cavity 60, and even a portion of the second portion 77 of gripping member 70 may also be disposed within the annular cavity 60. Due to interaction with forward facing tapered portion 37 on the inside surface 36 of shell 30, gripping member 70 is pushed radially inward.

At least a portion of jacket 210 and braided shield 208 are sandwiched between the gripping member 70 and the rear end 52 of the post 50. It is also, that in the forward position, the gripping member 70 forms a seal between jacket 210 and rear end 22 of body 20, sealing annular cavity 60 at rear end 22 of body 20. Also, in the forward position, gripping member 74 forms a seal between the body 20 and the inner surface 36 of the shell 30. Both rear and front ends 72, 74 of gripping member 70 are displaced radially inwardly in the forward position forming a dual grip against jacket 210. Additionally, in the forward position, a portion of jacket 210 flows into one or more of notches 73.

Notches 73 in gripping member 70 result in gripping member 70 being more easily forced under body 20 when driven axially forward by shell 30. Accordingly, notches 73 lower the direct axial compressive force required to close connector 10 around coaxial cable 200. Additionally, the flowing of jacket 210 into notches 73 when the gripping member 70 is forced under body 20 provides additional resistance to coaxial cable 200 rotation within connector 10 once connector 10 is secured onto coaxial cable 200. It should be noted that virtually any number of notches 73 or shapes, configurations, arrangements or geometries may be used as further discussed below. The notches 73 result in about a 30-35% reduction in axial compressive force needed to drive shell 30 axially forward and, thereby, force gripping member 70 under body 20.

Figure 5:
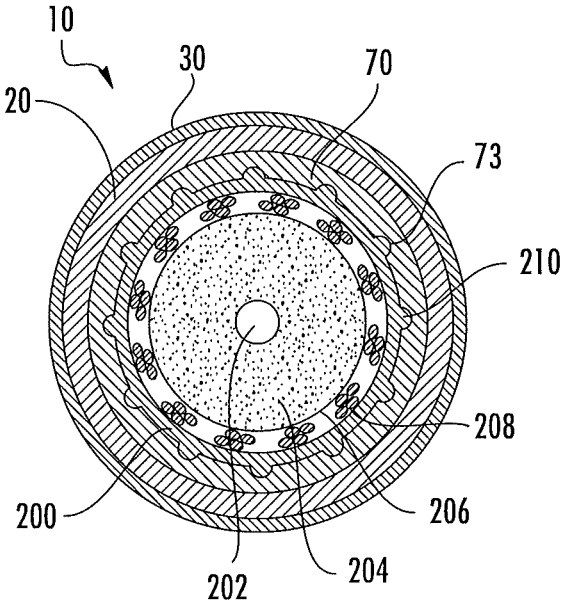
FIG. 5 is a cross-section view of the connector of FIG. 4.

FIG. 5 is a cross-section of connector 10 and cable 200 shown in FIG. 4. FIG. 5 shows a section transversely cut through shell 30, body 20, cable 200, jacket 210, gripping member 70, notches 73, braided shield 208, outer conductor 206, dielectric 204, inner conductor 202. FIG. 5 illustrates the relationship of the different component parts of connector 10 and cable 200 when cable 200 is inserted in connector 10 and connector 10 is closed or engaged. As can be seen, a portion of gripping member 70 is shown as having flowed into notches 73.

Figure 6:
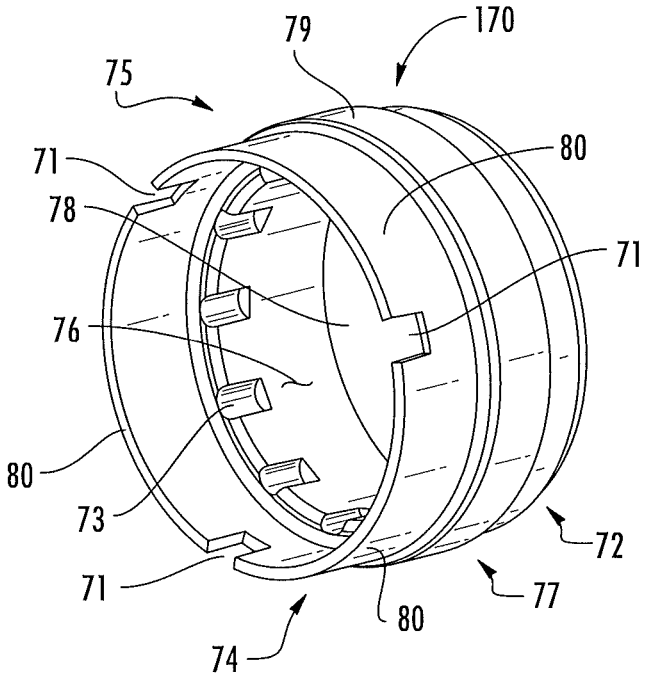
FIG. 6 is a detail, front perspective view of an exemplary embodiment of a gripping member.

FIG. 6 is a detail, front perspective view of gripping member 170. Gripping member 170 is similar to gripping member 70 with the exception that first portion 75 has at least one slot 71 cut through first portion 75 from inner surface 76 through outer surface 79 and extending a certain length from front end 74 into first portion 75. Slots 71 define sections 80 therebetween. Slots 71 and sections 80 are configured to facilitate inward radial displacement of the first portion 75 by interaction with rearward facing tapered portion 27, so that first portion 75 is disposed in the annular cavity 60, between body 20 and post 50. In this regard, slots 71 and sections 80 further act to lower the direct axial compressive force required to close connector 10 around coaxial cable 200 in addition to notches 73.

Figure 7:
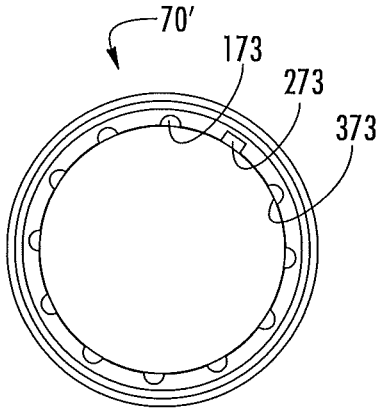
FIG. 7 is a detail, front view of a gripping member with different types and geometries of notches.

Referring to FIG. 7 there is shown a detail front view of gripping member 70'. FIG. 7 is provided to illustrate that notches may be of different types or geometries. As non-limiting examples, FIG. 7 illustrates notches 173, 273 and 373. Notch 173 is shown as having an arcuate section configuration, which may be, generally, in the form of a semicircle, but that is not necessary. Notch 273 is shown as having generally parallel sides connected by a perpendicular end as a partial rectangular cut configuration, while notch 373 is shown as having angled sides connected by an end, generally, in the form of a partial trapezoidal cut configuration. Gripping member 70 may have any combination of notch 73 configuration, for example, all notches 73 having the same configuration, or different notches 73 having different configuration. It is understood that notch 73 types and geometries are not intended to be limited to the configurations illustrated in FIG. 7.

Figure 8:
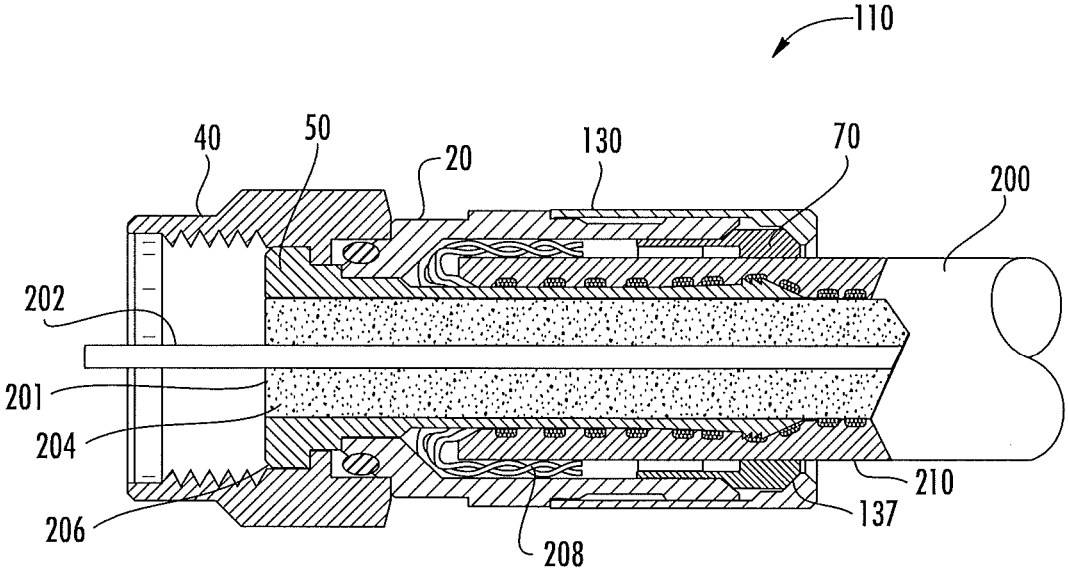
FIG. 8 is a side cutaway view of an embodiment of a connector comprising a gripping member and a shell with a forward facing straight portion in a forward position.

Referring now to FIG. 8, there is shown a cross-sectional view of connector 110. Connector 110 is similar to connector 10 with the exception that connector 110 does not have shell 30 with forward facing tapered portion 37. Instead, connector 110 includes shell 130 with forward facing straight portion 137. In a similar manner to forward facing tapered portion 37, as shell 130 is moved axially toward nut 40 forward facing straight portion 137 pushes gripping member 70 radially inward. Thus, as with connector 10, both rear and front ends 72, 74 of gripping member 70 are displaced radially inwardly in the forward position forming a dual grip against jacket 210.

Figure 9:
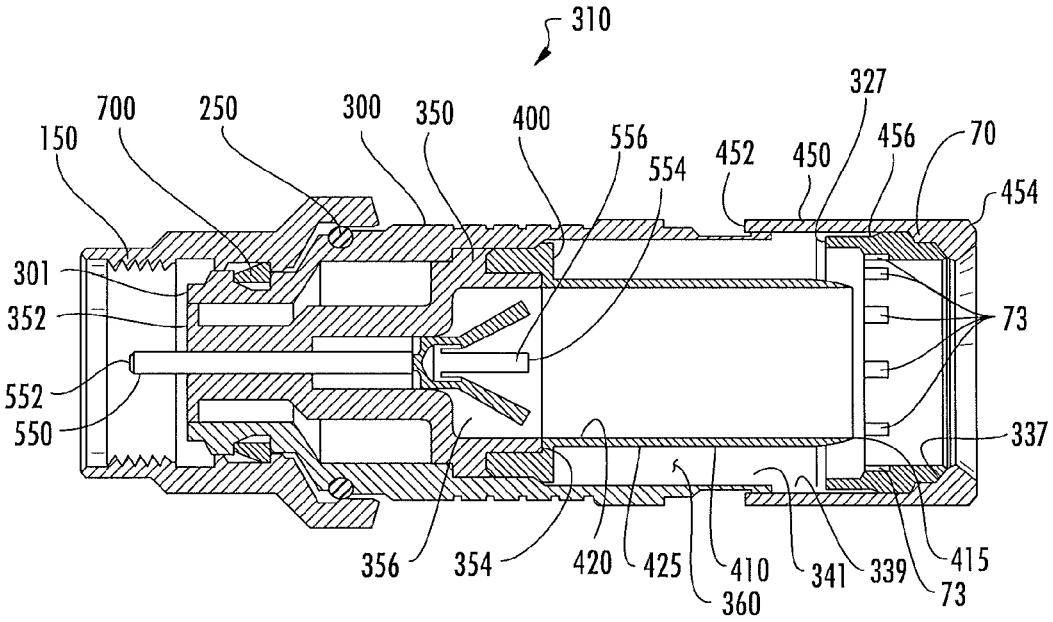
FIG. 9 is a side cutaway view of the connector having an integral pin a gripping member and a shell with a forward facing tapered portion in a rearward position.

FIG. 9 is a partial cutaway view along the centerline of an embodiment of connector 310. The connector 310 illustrated in FIG. 9 includes coupling nut 150, retaining ring 700, O-ring 250, generally cylindrical body 300, insulating member 350, post 400, shell 450, gripping member 70 with notches 73, pin 550, and optional seal ring 600. Coupling nut 150 is made from any suitable material, for example, metallic material, such as brass, and may be plated with a conductive, corrosion resistant material, such as nickel. Retaining ring 700 may be made from any suitable material, for example, a metallic material, such as heat treated beryllium copper. O-Ring 250 may be made from any suitable material, for example, a rubber-like material, such as EPDM (Ethylene Propylene Diene Monomer).

Body 300 has first end 339, second end 301, and a central bore 341 and may be made from any suitable material, for example, a metallic material, such as brass, and may be plated with a conductive, corrosion resistant material, such as nickel. Insulating member 350 includes a front end 352, a rear end 354, and an opening 356 between the front and rear ends and may be made from any suitable material, for example, an insulative plastic material, such as high-density polyethylene or acetal. At least a portion of rear end 354 of insulating member 350 is in contact with at least a portion of post 400. Post 400 includes a tubular shank 410 having a rear end 415, an inner surface 420, and an outer surface 425 and may be made from any suitable material, for example, a metallic material, such as brass, and may be plated with a conductive, corrosion resistant material, such as tin. Outer surface 425 of tubular shank 410 and central bore 341 of body 300 define an annular cavity 360 there between.

Shell 450 surrounds first end 339 of body 300 and includes a front end 452, a rear end 454, and an inner surface 456 defining a longitudinal opening between front end 452 and rear end 454 and is axially movable over body 300 between a rearward position and a forward position, in the same manner as connector 10. Shell 450 may be made from any suitable material, for example, a metallic material, such as brass, and may be plated with a conductive, corrosion resistant material, such as nickel. Gripping member 70 is similar to gripping member 70 in connector 10. Pin 550 has a front end 552, a rear end 554, and a flared portion 556 at its rear end 554 to assist in guiding an inner conductor of a coaxial cable into physical and electrical contact with pin 550. Pin 550 is inserted into and substantially along opening 356 of insulating member 350 and may be made from any suitable material, for example, a metallic material, such as brass, and may be plated with a conductive, corrosion resistant material, such as tin. Pin 550 and insulating member 350 are rotatable together relative to body 300 and post 400. Seal ring 600 may be made from any suitable material, for example, a rubber-like material, such as silicone.

In a similar fashion as discussed with respect to connector 10, as shell 450 and post 50 are moved together axially by tool (not shown) front end 452 of shell 450 moves over an outside portion of body 300, causing gripping member 70 to move axially forward toward body 300 as well. First portion 75 of gripping member 70 is displaced radially inward by interaction with rearward facing tapered portion 327 at first end 339 and first portion 75 is disposed in the annular cavity 360, between body 300 and post 400. As can be seen, first portion 75 of the gripping member 70 is fully disposed in the annular cavity 360, and even a portion of the second portion 77 of gripping member 70 is also disposed within the annular cavity 360. Due to interaction with forward facing tapered portion 337 on the inside surface 456 of shell 450, gripping member 70 is pushed radially inward.

At least a portion of jacket 210 and braided shield 208 (not shown) are sandwiched between the gripping member 70 and the rear end 415 of the post 400. It is also, that in the forward position, the gripping member 70 forms a seal between jacket 210 and rear end 339 of body 300, sealing annular cavity 360 at rear end 339 of body 300. Also, in the forward position, gripping member 74 forms a seal between the body 300 and the inner surface 456 of the shell 450. Both rear and front ends 72, 74 of gripping member 70 are displaced radially inwardly in the forward position forming a dual grip against jacket 210. Additionally, in the forward position, a portion of jacket 210 flows into one or more of notches 73.

It will be apparent to those skilled in the art that various modifications and variations can be made without departing from the spirit or scope of the disclosure. Since modifications combinations, sub-combinations and variations of the disclosed embodiments incorporating the spirit and substance of the disclosure may occur to persons skilled in the art, the disclosure should be construed to include everything within the scope of the appended claims and their equivalents.

What is claimed is:

1. A gripping member for a coaxial cable connector, the gripping member comprising:

a front end and a rear end opposite the front end;

an outer surface and an inner surface defining a longitudinal hole extending between the front end and the rear end;

a first portion which terminates at the front end; and a second portion which terminates at the rear end and comprising at least one notch which extends from the inner surface of second portion to a certain depth from inner surface, wherein the gripping member is configured to secure a coaxial cable to a coaxial cable connector, wherein the coaxial connector has a body, a shell coupled to the body and a gripping member with a notch to a certain depth from an inner surface disposed on an inner surface of the shell.

2. The gripping member of claim 1, wherein the gripping member is configured to be displaced radially inwardly when the gripping member is forced under the body of a coaxial cable connector.

3. The gripping member of claim 1, wherein the front end of the gripping member is configured to be displaced radially inwardly when the gripping member is forced under the body of a coaxial cable connector.

4. The gripping member of claim 1, wherein the rear end of the gripping member is configured to be displaced radially inwardly when the gripping member is forced under the body of a coaxial cable connector.

5. The gripping member of claim 1, wherein the first portion comprises at least one slot cut through the first portion from the inner surface through the outer surface and extending a certain length from the front end into first portion.

6. The gripping member of claim 5, wherein the first portion comprises a plurality of slots.

7. The gripping member of claim 6, wherein the plurality of slots define sections there between.

8. The gripping member of claim 7, wherein the slots and the sections are configured to facilitate an inward radial displacement of the first portion when the gripping member is driven axially forward.

9. A connector for coupling an end of a coaxial cable to a terminal, the coaxial cable comprising an inner conductor, a dielectric surrounding the inner conductor, an outer conductor surrounding the dielectric, a braided shield surrounding the dielectric, and a jacket surrounding the braided shield, the connector comprising:

a body comprising a rear end, a front end, and an internal surface extending between the rear and front ends of the body, the internal surface defining a longitudinal hole;

a shell comprising a rear end, a front end surrounding at least a portion of the body, and an inner surface defining a longitudinal hole extending between the rear and front ends of the shell, the shell being axially movable over an outside portion the body between a rearward position and a forward position;

a post disposed at least partially within the longitudinal hole of the body, the post having a rear end, an inner surface and an outer surface, and wherein the outer surface of the post and the internal surface of the post define an annular cavity therebetween; and a gripping member disposed within the longitudinal hole of the shell between the front and rear ends thereof, the gripping member comprising a front end, a rear end, an outer surface, an inner surface defining an opening therein, a first portion adjacent the front end, and a second portion adjacent the rear end, wherein the second portion comprises at least one notch which extends from the inner surface of second portion to a certain depth from inner surface, wherein the gripping member is configured to secure a coaxial cable to a coaxial cable connector.

10. The connector of claim 9, wherein the gripping member secures the coaxial cable to the coaxial cable connector when at least part of the gripping member is forced under the body when driven axially forward by the shell.

11. The connector of claim 9, wherein the first portion comprises a plurality of slots cut through the first portion from the inner surface through the outer surface and extending a certain length from the front end into first portion, and wherein the plurality of slots define sections there between.

12. The connector of claim 9, wherein the slots and the sections are configured to facilitate an inward radial displacement of the first portion when the gripping member is driven axially forward.

13. The connector of claim 9, wherein, in the forward position, the inner surface of the deformable gripping ring, from the rear end to the front end thereof, contacts the jacket of the cable.

14. The connector of claim 13, wherein a portion of the jacket flows into one or more of the notches in the forward position.

* * * * *